US005358176A

United States Patent [19]

Rigby

[11] Patent Number: 5,358,176

[45] Date of Patent: Oct. 25, 1994

[54] TEAR STRIP OPENING FOR A PAPERBOARD CONTAINER

[75] Inventor: William R. Rigby, Newark, Del.

[73] Assignee: Westvaco Corporation, New York, N.Y.

[21] Appl. No.: 238,730

[22] Filed: May 5, 1994

[51] Int. Cl.[5] ..... B65D 5/54

[52] U.S. Cl. ..... 229/240; 229/227; 229/237

[58] Field of Search ..... 229/227, 237, 240, 243, 229/244

[56] References Cited

U.S. PATENT DOCUMENTS

| | | | |
|---|---|---|---|
| 2,680,558 | 6/1954 | Mai . | |
| 3,022,931 | 2/1962 | Guyer | 229/244 |
| 3,110,434 | 11/1963 | Linda et al. | 229/240 |
| 3,291,372 | 12/1966 | Saidel | 229/237 |
| 3,325,081 | 6/1967 | Mahon | 229/244 |
| 3,410,476 | 11/1968 | Buttery | 229/227 |
| 3,478,953 | 11/1969 | Forrer et al. . | |
| 3,482,758 | 12/1969 | LaPierre et al. | 229/240 |
| 3,547,328 | 12/1970 | Bjorklund | 229/237 |
| 4,111,306 | 9/1978 | Roccaforte | 229/240 |
| 4,815,609 | 3/1989 | Kiedaisch | 229/240 |
| 4,836,438 | 6/1989 | Rigby | 229/237 |
| 4,865,203 | 9/1989 | Ueda | 229/237 |
| 4,930,639 | 6/1990 | Rigby . | |
| 4,951,824 | 8/1990 | Kuchenbecker et al. . | |
| 5,085,323 | 2/1992 | Kuchenbecker et al. . | |
| 5,217,159 | 6/1993 | Calvert et al. . | |
| 5,228,272 | 7/1993 | Calvert et al. . | |

*Primary Examiner*—Gary E. Elkins

[57] ABSTRACT

A tearstrip opening for the closure flap of a paperboard container is formed by a single line of tear and an adjacent delamination area located within the closure flap. The tearstrip is applied to one or more of the closure flaps of the container as required. The tearstrip is removed by the combined action of separation of the paperboard along perforations which define the single line of tear and ply separation of the paperboard adjacent to a partial depth cut line of weakness spaced from the single line of tear. When removed, the tear strip releases the closure flap from a side wall of the container while leaving a portion of the closure flap still attached to the side wall.

15 Claims, 5 Drawing Sheets

TEAR STRIP OPENING FOR A PAPERBOARD CONTAINER

BACKGROUND OF THE INVENTION

The present invention relates generally to the art of food packaging and more particularly to a paperboard container for packaging, storing and heating food, and a means for opening the container.

Containers of the type disclosed herein are well known in the art. They are low in cost, disposable and adapted to be used in the preparation of food, particularly for use in a microwave oven. In its preferred embodiment, the present invention represents an improvement to the ovenable food container disclosed in U.S. Pat. No. 4,930,639, owned by the present assignee herein. Other examples of opening schemes as disclosed herein may be found in U.S. Pat. Nos. 2,680,558; 3,478,953; 4,951,824; 5,085,323; and 5,217,154, also owned by the present assignee herein. The opening schemes disclosed in these prior art patents include either a removable tear strip formed by one or more lines of perforations, or a delamination type opening. The opening means disclosed herein is an improvement over those shown in the prior art since it combines the best features of the different types previously used, namely, a combination tearing and delamination action to achieve a more reliable and efficient tear strip.

SUMMARY OF INVENTION

According to the present invention, a paperboard container is disclosed for the packaging, storing and heating of food which finds particular utility in microwave cooking. The invention herein resides in an improved means for opening such containers. The containers are preferably constructed from a thermally stable paperboard material, generally referred to in the art as "ovenable" paperboard. Ovenable paperboard is typically coated on at least one surface with a heat sealable, thermoplastic food contact material, for example, low density polyethylene, polypropylene, polyester or the like, and the other surface is coated with a clay pigmented coating suitable for the printing of graphics. Containers prepared from such material are normally heat sealed during the forming and closing processes. However, since it is substantially impossible to heat seal the clay coated outer surfaces of such containers to the inner thermoplastic coated surfaces of the containers, the present invention may advantageously utilize the heat seal coating technology disclosed in U.S. Pat. Nos. 5,217,159 and 5,228,272, both owned by the present assignee herein. The heat seal coatings disclosed in these patents may be printed on the container blanks prepared from ovenable paperboard in selected areas where it is desired to seal thermoplastic coated surfaces to clay coated surfaces.

The preferred container of the present invention comprises a tray with an integral lid although other style containers are contemplated by the invention including containers comprising separate lids and trays. In any case, the tray includes a base panel of generally polygonal shape, a plurality of upstanding side walls comprising at least two opposed side walls, a front wall and a rear wall, and in the preferred embodiment, an integral lid foldably attached to either the front or rear wall. The upstanding side walls may extend perpendicularly from the base panel, or may be angularly related to the base panel to yield a tray with tapered walls to permit the formed trays to be readily nested for stacking. The side walls are preferably interconnected at each corner by corner closures in the form of gusset panels. These may be bonded together when the tray is set up, and bonded to an adjacent side wall, or merely bonded together as an extension of a side wall, to achieve a leakproof interior. A construction of this type provides an interior with no exposed raw edges. In the preferred embodiment of the present invention, each of the opposed side walls also include flange extensions which are foldably attached to the upper edges thereof to provide side wall flanges at each side of the container. One of the gusset panels at each corner may also include an upper flange extension which can be bonded to the lower surface of the side wall flange when the container is formed to achieve enhanced structural strength. The lid panel for this embodiment is sized so as to overlap and become bonded to or preferably heat sealed to the side wall flanges when the container is closed after filling. Meanwhile when an integral lid is foldably attached to the rear wall, a front closure flap is also foldably attached to the leading edge of the lid panel so that it may overlap and become bonded to the front wall of the container to complete the enclosure. In the embodiments of the present invention which do not include side wall flanges, the lid is preferably provided with additional closure flaps which overlap the side walls in addition to the front closure flap, and for containers having separate lids, closure flaps are provided for each of the container walls. For these embodiments and for the embodiments which utilize a separate lid, the tear strip opening of the present invention may be applied to one or more of the overlapping closure flaps. When the lid is bonded to side wall flanges, the tear strip opening need only be applied to a single closure flap if an integral lid is employed, or to two closure flaps if a separate lid is employed. For the preferred embodiment using either an integral lid bonded to side wall flanges or a separate lid, the lid itself is preferably provided with partial depth cut lines of weakness located on the inner surface of the lid, interiorly of the bond between the lid and side wall flanges to produce areas of delamination. The partial depth cut lines weaken the paperboard in the area between the lid-to-flange bond which permits the paperboard to delaminate easily when the lid is lifted to open the container. This delamination action of the paperboard leaves a portion of the lid still attached to the side wall flanges to provide additional strength to the container tray after the lid is removed. In the instance where it is desired to remove the lid completely from a container with an integral lid, lines of perforation or partial depth cut lines of weakness may be included at or adjacent to the fold line connecting the lid to the rear wall.

For those embodiments where the lid includes closure flaps which overlap both the front and side walls, and for containers with separate lids, the container may be readily opened merely by releasing the closure flaps from the respective walls and lifting the lid. This procedure is readily accomplished according to the present invention with the use of the novel tear strip construction described in more detail hereinafter. For the present, the tear strip opening of the present invention may be described as one which uses in combination, a delamination area and a single line of perforations. This combination yields a removable tear strip that incorporates the best features of the tear strips shown in the prior art, but is more reliable and easier to use than the prior art opening means.

DETAILED DESCRIPTION

Figure 1:
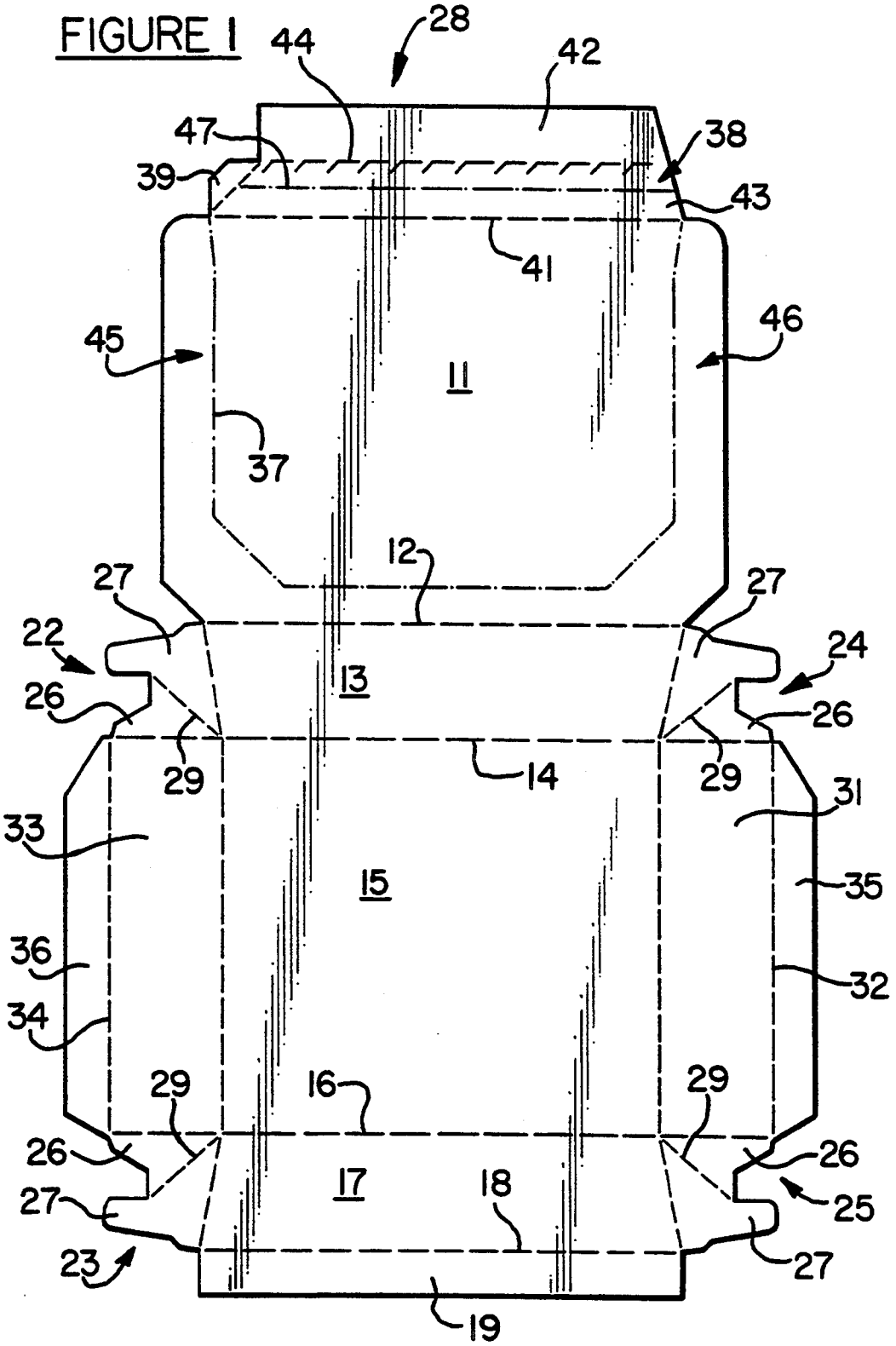
FIG. 1 is a plan view of a typical paperboard blank for constructing the container of the present invention.
Figure 3:
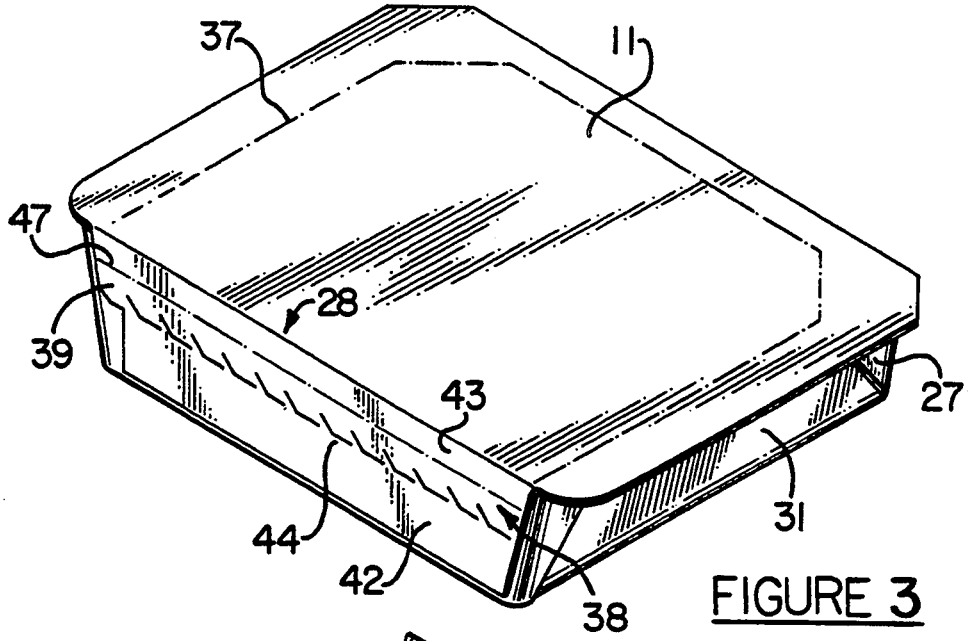
FIG. 3 is a perspective view of a container prepared from the blank of FIG. 1.
Figure 4:
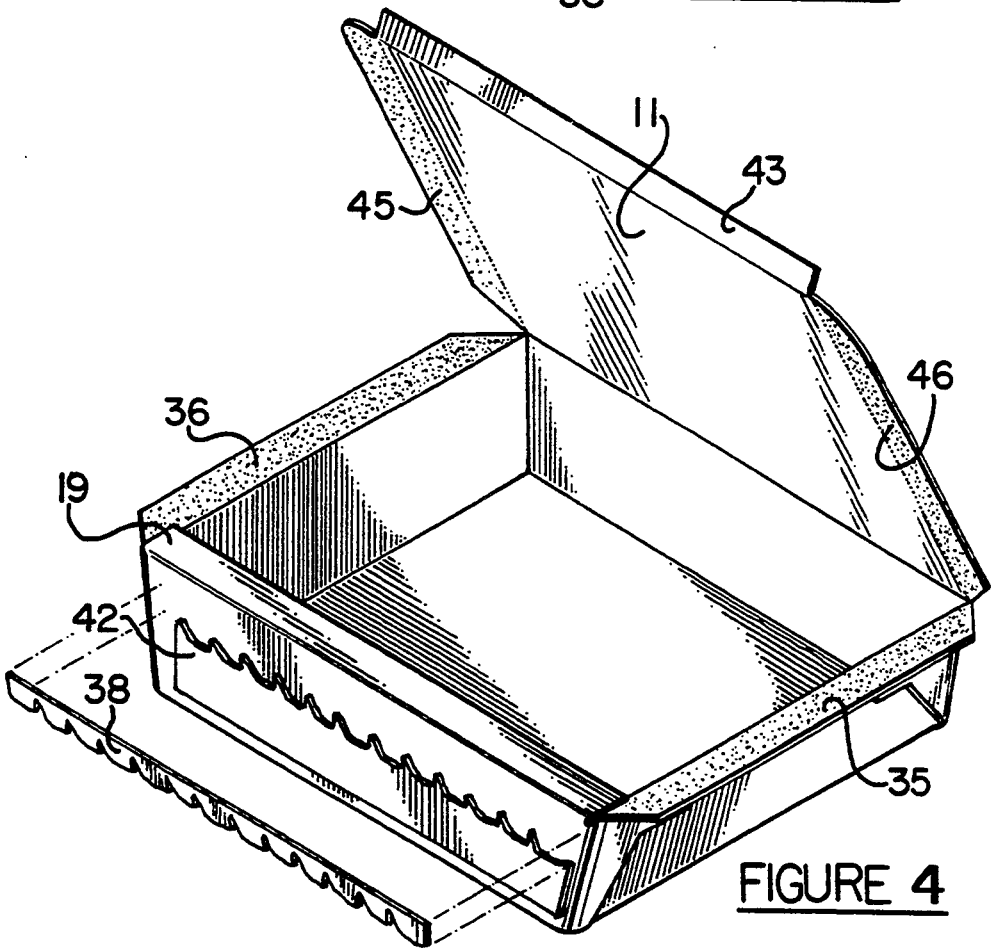
FIG. 4 is a perspective view of the container of FIG. 3 when opened.

Referring now more particularly to the drawing, the paperboard blank of FIG. 1 is illustrated as having a substantially rectangular base panel 15, however the shape could be of any desired polygonal form having multiple sides. A plurality of side walls 13, 17, 31 and 33 are shown foldably connected to the base panel 15, and each of the opposed side walls 31, 33 also include flange extensions 35 and 36 foldably attached to the upper edges thereof. These flanges 35, 36 are disposed in a plane substantially parallel to that of base panel 15 when the blank is formed into a container as shown in FIGS. 3 and 4. In the preferred embodiment of the present invention, the front and rear walls 13, 17 are preferably perpendicular to the base panel 15 and the two side walls 31, 33 diverge outwardly with respect to the base panel. Although all of the side walls could be arranged perpendicular to the base panel 15, the slight divergence of the side walls permit the trays to be nested for storage in a minimum amount of space after being formed.

Referring particularly to FIG. 1, it will be seen that the flange extensions 35, 36 are foldably connected to the side walls 31, 33 along score lines 32 and 34 respectively. Meanwhile, the side walls 13, 17 are connected to one another by gusset panels 22, 23, 24 and 25. Each gusset panel set preferably includes a pair of panels 26, 27 connected to one another along diagonal score lines 29 and between the front, rear and side walls. The blank may also include a dust flap 19 foldably attached to the front wall 17 along score line 18.

At the top of the blank as illustrated in FIG. 1, the lid portion 11 is provided with extended areas 45, 46 at each side thereof for overlapping the flange extensions 35, 36 of the tray portion when the container is closed, and a front closure flap 28. The front closure 28 is divided into two parts 42 and 43 which are separated from one another by the novel tear strip 38 of the present invention. The tear strip 38 is defined along one edge by a single line of tear provided by perforations 44 which are cut through the thickness of the paperboard, and along the other edge by a partial depth, cut line of weakness 47 applied to the inner surface of the closure flap which provides a delamination area between the partial depth cut line 47 and the combination partial depth cut/score line 41 between lid 11 and closure flap 28. In addition, the lid 11 is provided with its own partial depth cut line of weakness 37 located preferably on the inner surface of the lid, interiorly of the bond between the extended areas 45, 46 of the lid and the flanges 35, 36 to provide a delaminatable opening within the lid.

When the tray portion of the container is formed, the gusset panels at the corners 22-25 are folded together and toward the side walls 31, 33 with panels 26 lying adjacent to the side walls. Panels 26, 27 are bonded together and may be bonded to the side walls 31, 33 if desired. A heat seal coating as disclosed in the previously mentioned prior art patents may be used for bonding the clay coated surfaces of the gusset flaps and tray side walls to one another. The dust flap 19 is folded inside the container so that at this point, a fully set up tray is produced which is leakproof and which has no raw edges exposed to the interior. After the tray is filled, the container is closed by folding the lid down into contact with the tray flanges where the extended areas 45, 46 of the lid are bonded to the flanges 35, 36. To complete the closure, flap 28 is folded over into contact with the front wall 17 where the portion 42 of the closure flap is bonded to the front wall. In this instance, the inside surface of the closure flap 28 is coated with a thermoplastic coating and the outer surface of the front wall 17 is clay coated. To complete this bond, the heat seal coatings disclosed in prior art U.S. Pat. Nos. 5,217,159 and 5,228,272 may be advantageously used.

FIG. 4 illustrates the open condition of the container shown in FIG. 3. This is accomplished by first removing the tear strip 38, defined by the single line of tear 44 and the partial depth cut line of weakness 47, to free the flap portion 43 from flap portion 42. The tear strip 38 is removed with the aid of a lift tab 39 located at one end. As the tear strip 38 separates from the front flap 28, the paperboard material separates along the perforations of the single line of tear 44 and delaminates in the region adjacent to the partial depth cut line 47. This combination of delamination and separation provides a reliable and effective opening means with little or no chance of the tear strip fracturing prematurely or being inadvertently broken before the entire tear strip is successfully removed. This has not been the case with the prior art opening schemes where a delamination-only opening might resist delamination, or a perforated line-only opening might fail to separate causing the tear strip to fracture. Once the closure flap 28 is released for venting the container, further opening of the container is achieved by simply lifting the lid using the portion 43 of the closure flap 28 which remains. This action causes the paperboard in the region of the bond between flanges 35, 36 and the extended portions 45, 46 to delaminate along the partial depth cut line of weakness 37, leaving delaminated parts of the lid 11 attached to the tray flanges. At this point, the front wall dust flap 19 prevents inadvertent spillage of any contents from the front of the tray, and the portions of the lid 11 that delaminated to the tray flanges 35, 36 gives the tray increased rigidity. When it is desired to remove the lid completely from the tray, the lid may be separated along the portion of the partial depth cut line of weakness 37 adjacent to the combination partial depth cut/-score fold line 12 between lid 11 and rear wall 13.

Figure 2:
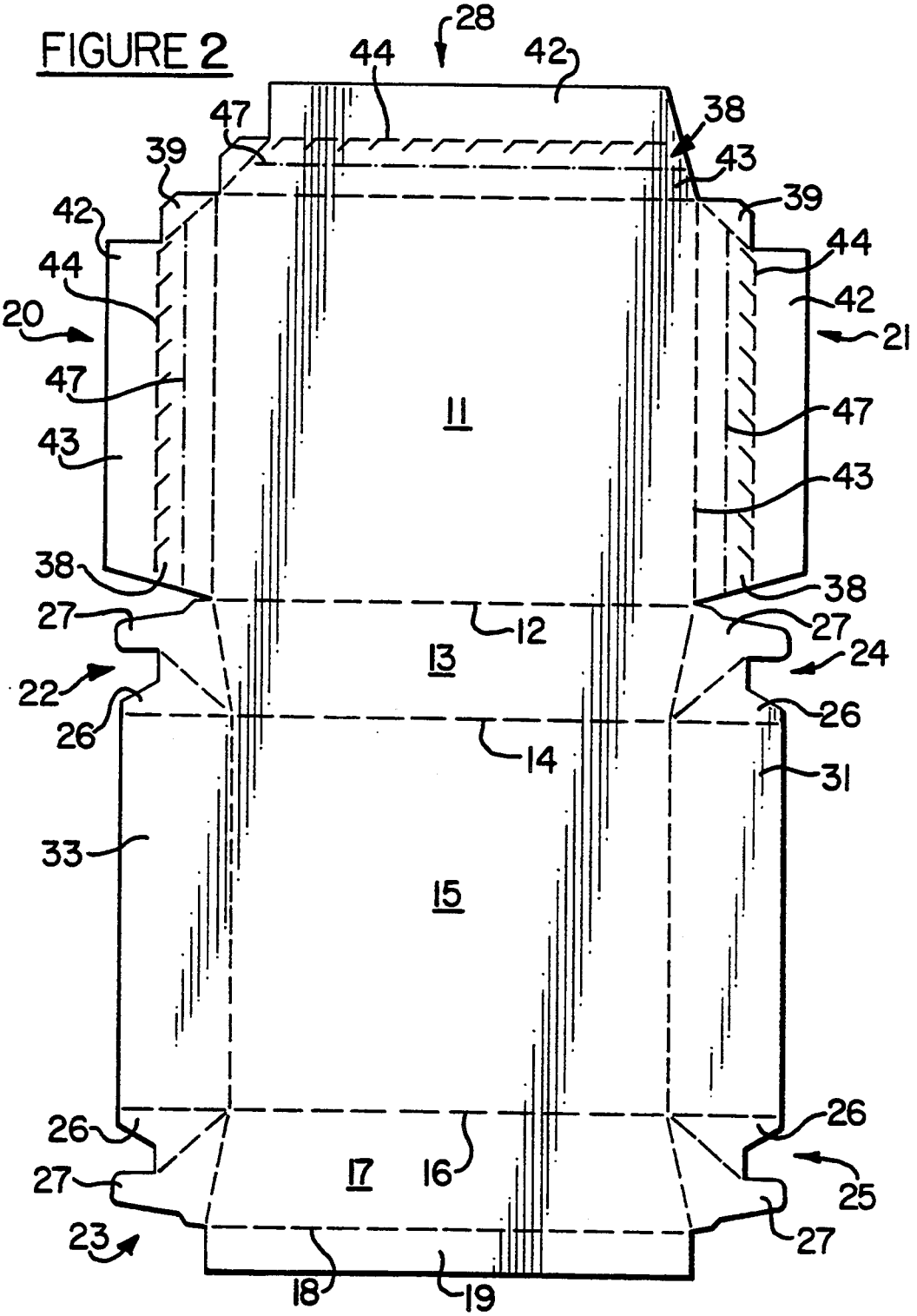
FIG. 2 is a plan view of a modified blank according to the present invention.
Figure 5:
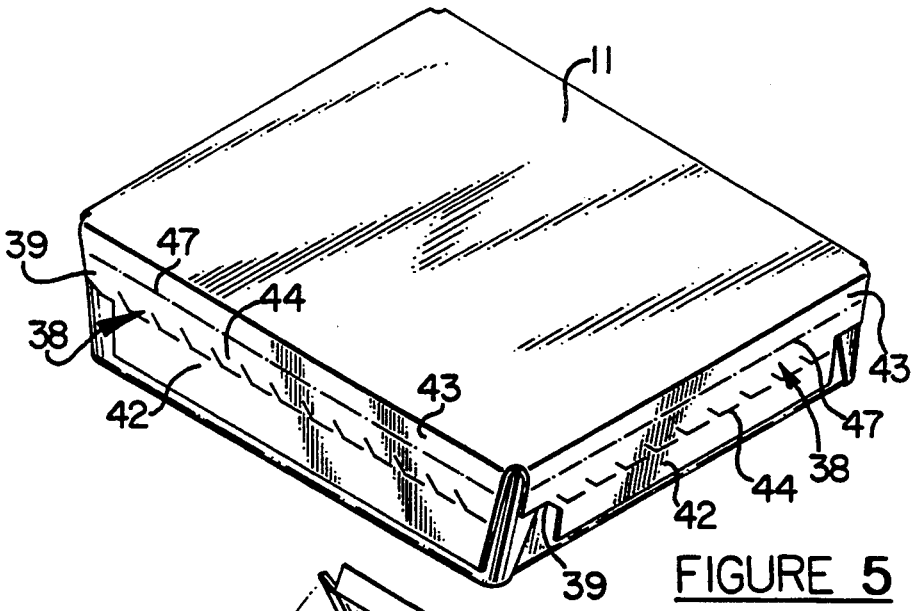
FIG. 5 is a perspective view of a container prepared from the blank of FIG. 2.
Figure 6:
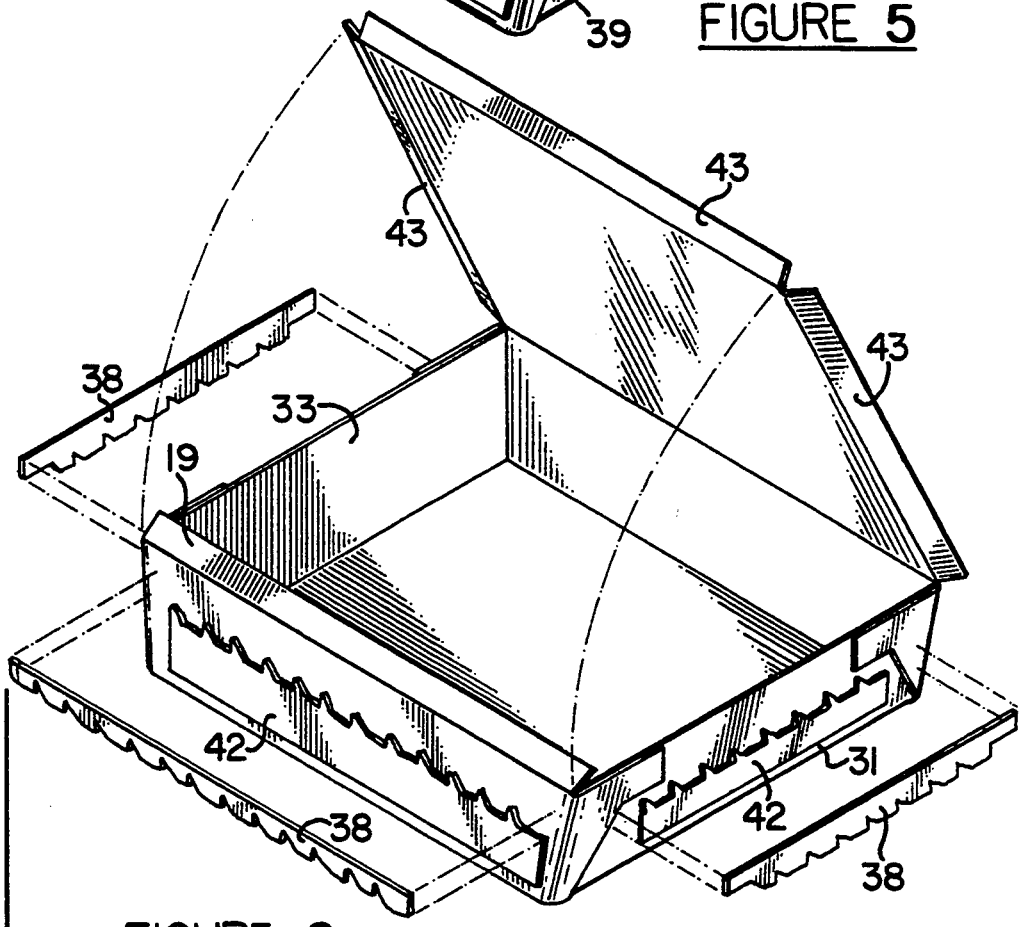
FIG. 6 is a perspective view of the container of FIG. 5 when opened; and, FIG. 7 illustrates a two piece container with a separate lid and tray which includes tear strips on each of the closure flaps which overlap the tray side walls.
Figure 7:
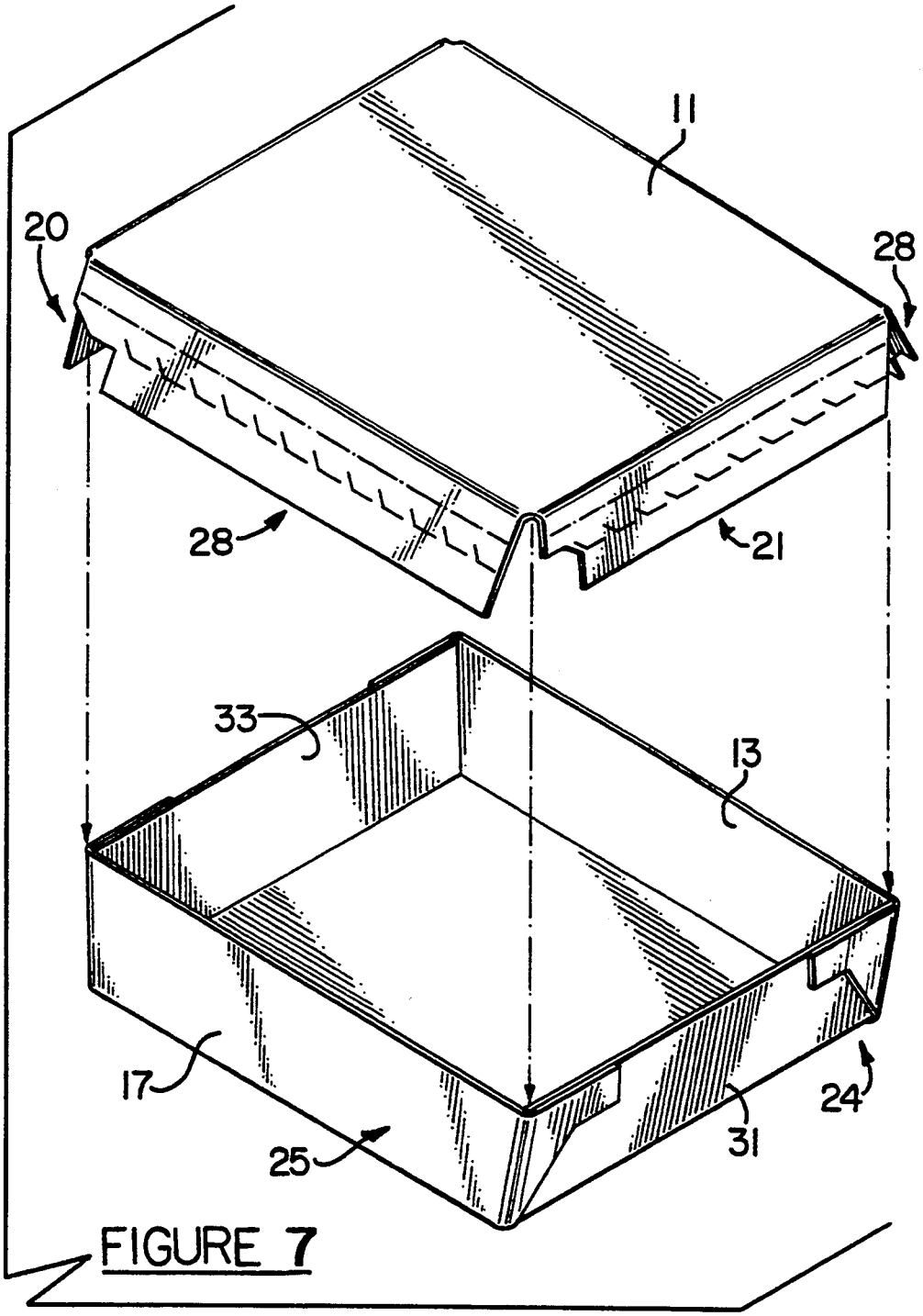

The blank shown in FIG. 2 illustrates a second embodiment of the present invention for a container which does not include flanges on the tray. In this embodiment, the container is closed by incorporating closure flaps on all sides of the lid which are not attached to a side wall. Since the blank of FIG. 2 shows a tray with four side walls and the lid is integral with one of the side walls, closure flaps are included on the remaining three sides of the lid. If the lid were separate from the tray, closure flaps would be required on all four sides of the lid as shown in FIG. 7. Note the closure flaps 20 and 21 in FIG. 2 which overlap and are bonded to the side walls 31, 33 of the container shown in FIGS. 5 and 6, in addition to the front wall closure flap 28, described hereinbefore in connection with the embodiment of FIGS. 3 and 4. Each of the closure flaps 20, 21 and 28 are preferably substantially identical in construction and include lift tabs 39 at one end for initiating removal of the tear strips 38. The tear strips 38 are each defined by the combination of a single line of tear provided by perforated lines along one edge, and a partial depth cut line of weakness 47 along the other edge. When these tear strips are removed, the flap portions 43 are released from portions 42 which remain bonded to the respective side walls, and the lid can be readily lifted to expose the contents of the tray. If desired, the lid can be completely removed from the tray by perforating the score line 12 between the lid 11 and rear wall 13. As in the case of the embodiment of FIGS. 3 and 4, the tear strips 38 of FIG. 5 are easily and reliably removed as shown in FIG. 6, due to the combined action of tearing of the paperboard along perforated line 44, and delamination of the paperboard between the partial depth cut lines 47 and the fold lines attaching the closure flaps 20, 21 and 28 to lid 11.

For an embodiment where the lid is formed from a separate blank of paperboard, the lid would include a closure flap for each side wall of the container. The tear strip of the present invention could then be incorporated in one or more of these closure flaps as illustrated in FIG. 7. Moreover, when applied to a tube-type container formed from interconnected panels, the tear strip of the present invention could be applied at one or both ends of the container.

It will thus be seen that there has been fully described herein several different applications for a new and improved opening means for a paperboard container. The preferred container of the present invention is particularly useful for preparing and cooking foods in a microwave oven, as well as for packaging the food prior to cooking. Accordingly it will be understood that while only exemplary embodiments have been fully described, the invention includes all alternatives, modifications, and equivalents that may be encompassed within the spirit and scope of the appended claims.

What is claimed is:

1. A paperboard container including at least one closure flap, said closure flap having an inner surface and an outer surface wherein the inner surface of said closure flap is adhered to a panel of said container to close the container, the improvement comprising means for opening said container, said opening means further comprising a removable tear strip incorporated into the closure flap, said tear strip being defined along one edge by a single line of perforations cut through the thickness of the paperboard and along another edge by a partial depth cut line of weakness applied to the inner surface of the closure flap, wherein removal of said tear strip to open the container is accomplished by the combined action of a separation of the paperboard along the single line of perforations and a delamination of the paperboard at the outer surface of the closure flap adjacent to the partial depth cut line of weakness.

2. The container of claim 1 wherein the single line of perforation and partial depth cut line of weakness lie adjacent to one another and extend across substantially the entirety of the width of the closure flap.

3. The container of claim 2 wherein the container includes a plurality of interconnected panels and end flaps wherein said closure flap overlaps one of said end flaps to close the container.

4. The container of claim 2 wherein the container includes a bottom panel with side walls and a lid wherein said closure flap overlaps at least one side wall of the container.

5. The container of claim 4 wherein the closure flap is foldably attached to the lid along a first fold line.

6. The container of claim 5 wherein the closure flap comprises a first part remote from said first fold line which is bonded to the container side wall, the tear strip, and a second part adjacent to said first fold line which is connected to the lid.

7. The container of claim 6 wherein the lid is integral with said container and is connected to a side wall thereof along a second fold line.

8. The container of claim 7 wherein the container comprises a front wall, rear wall and a pair of opposed side walls.

9. The container of claim 8 wherein the opposed side walls include flanges and the lid includes extended portions which overlap and are bonded to the flanges to close the container.

10. The container of claim 9 wherein the lid further includes partial depth cut lines of weakness on the inner surface thereof located interiorly of the bond between the flanges and the extended portions of the lid.

11. The container of claim 8 wherein the lid is integral with the rear wall of the container and includes closure flaps overlapping the front wall and both opposed side walls of the container.

12. The container of claim 11 wherein a tear strip is incorporated into each of the closure flaps of said lid.

13. The container of claim 6 wherein the lid is separate from said container and includes closure flaps overlapping each of the side walls of the container.

14. The container of claim 13 wherein a tear strip is incorporated into at least one of the closure flaps of said lid.

15. The container of claim 2 wherein a heat seal coating is printed on the panel of the container to permit bonding of the closure flap to the container panel.

* * * * *